US008988180B2

(12) United States Patent
Arata et al.

(10) Patent No.: US 8,988,180 B2
(45) Date of Patent: Mar. 24, 2015

(54) MULTILAYER COIL COMPONENT

(71) Applicant: TDK Corporation, Tokyo (JP)

(72) Inventors: Masazumi Arata, Tokyo (JP); Yoji Tozawa, Tokyo (JP); Takashi Endo, Tokyo (JP); Toshiki Satoh, Tokyo (JP); Takuya Kamei, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/757,134

(22) Filed: Feb. 1, 2013

(65) Prior Publication Data

US 2013/0257576 A1 Oct. 3, 2013

(30) Foreign Application Priority Data

Mar. 30, 2012 (JP) ..... 2012-078834

(51) Int. Cl.

| | |
|---|---|
| ***H01F 27/29*** | (2006.01) |
| ***H01F 5/00*** | (2006.01) |
| ***H01F 27/24*** | (2006.01) |
| ***H01F 27/28*** | (2006.01) |
| ***H01F 17/00*** | (2006.01) |

(52) U.S. Cl.

CPC ..... *H01F 27/2804* (2013.01); *H01F 17/0013* (2013.01); *H01F 27/292* (2013.01)

USPC ..... 336/192; 336/200; 336/234

(58) Field of Classification Search

USPC ..... 336/200, 83, 234, 192

See application file for complete search history.

(56) References Cited

U.S. PATENT DOCUMENTS

| | | | | |
|---|---|---|---|---|
| 5,349,743 | A | 9/1994 | Grader et al. | |
| 5,479,695 | A | 1/1996 | Grader et al. | |
| 6,154,114 | A * | 11/2000 | Takahashi | 336/200 |
| 6,304,164 | B1 * | 10/2001 | Ohno et al. | 336/200 |
| 6,380,619 | B2 * | 4/2002 | Ahiko et al. | 257/703 |
| 7,176,772 | B2 * | 2/2007 | Maeda et al. | 336/200 |
| 7,679,475 | B2 * | 3/2010 | Yoshikawa | 333/204 |
| 2012/0049974 | A1 * | 3/2012 | Masuda et al. | 333/116 |

FOREIGN PATENT DOCUMENTS

| | | |
|---|---|---|
| JP | A-H6-096940 | 4/1994 |
| JP | A-2002-280253 | 9/2002 |
| JP | A-2007-12680 | 1/2007 |
| JP | A-2007-066973 | 3/2007 |
| JP | A-2009-290677 | 12/2009 |
| JP | A-2012-49694 | 3/2012 |
| KR | A-10-2005-0084853 | 8/2005 |
| WO | WO 2005/036566 A1 | 4/2005 |
| WO | WO 2011/135936 A1 | 11/2011 |
| WO | WO 2011/155240 A1 | 12/2011 |

* cited by examiner

*Primary Examiner* — Mangtin Lian
(74) *Attorney, Agent, or Firm* — Oliff PLC

(57) ABSTRACT

A multilayer coil component has an element body, a coil, a pair of first external electrodes, a pair of second external electrodes, a first connection conductor, and a second connection conductor. The coil is composed of a plurality of internal conductors arranged in the element body and connected to each other. The first external electrodes are arranged on a first principal face of the element body. The second external electrodes are arranged on the first principal face. The first connection conductor is arranged between the coil and the first external electrodes in the element body and is connected to one end of the coil and to the first external electrodes. The second connection conductor is arranged between the coil and the second external electrodes in the element body and is connected to the other end of the coil and to the second external electrodes.

6 Claims, 5 Drawing Sheets

MULTILAYER COIL COMPONENT

BACKGROUND OF THE INVENTION

1. Field of the Invention

The present invention relates to a multilayer coil component.

2. Related Background Art

There is a known multilayer coil component having an element body having of a plurality of insulator layers laminated together, a coil composed of a plurality of internal conductors arranged in the element body and connected to each other, a pair of external electrodes arranged at one end side on a mount surface of the element body, and a pair of external electrodes arranged at the other end side on the mount surface of the element body (e.g., cf. Patent Literature 1: International Publication WO2011/155240). In the multilayer coil component described in Patent Literature 1, only one of each pair of the external electrodes respectively arranged at the one end side and at the other end side on the mount surface is connected to the coil.

SUMMARY OF THE INVENTION

In electronic components of this kind, the external electrodes are normally electroplated to improve the solderability. In the multilayer coil component described in Patent Literature 1, since only one of each pair of the external electrodes is connected to the coil, the other external electrodes are not connected to the coil. Namely, the other external electrodes are in an electrically floating state. During execution of electroplating, therefore, an adequate electric field is not applied to the other external electrodes in the electrically floating state, which makes it difficult to form a plated layer thereon. If the plated layer is not adequately formed (e.g., if the plated layer is too thin), adhesion strength will become weak between the external electrodes and the plated layer, which can cause reduction in mounting strength of the multilayer coil component.

It is an object of the present invention to provide a multilayer coil component allowing adequate electroplating on the external electrodes.

A multilayer coil component according to the present invention is one comprising: an element body including a laminate of insulator layers, and having first and second principal faces of a substantially rectangular shape opposed to each other, first and second side faces extending in a short-side direction of the first and second principal faces so as to connect the first and second principal faces, and opposed to each other, and third and fourth side faces extending in a long-side direction of the first and second principal faces so as to connect the first and second principal faces, and opposed to each other; a coil composed of a plurality of internal conductors arranged in the element body and connected to each other; a pair of first external electrodes arranged at an end portion of the first principal face nearer the first side face; a pair of second external electrodes arranged at an end portion of the first principal face nearer the second side face; a first connection conductor arranged between the coil and the pair of first external electrodes in the element body and connected to one end of the coil and to the pair of first external electrodes; and a second connection conductor arranged between the coil and the pair of second external electrodes in the element body and connected to the other end of the coil and to the pair of second external electrodes.

In the multilayer coil component according to the present invention, since the pair of first external electrodes are electrically connected through the first connection conductor to the one end of the coil, neither of the first external electrodes is in the electrically floating state. Since the pair of second external electrodes are electrically connected through the second connection conductor to the other end of the coil, neither of the second external electrodes is in the electrically floating state. As a consequence of these, an adequate electric field is applied to the respective pairs of first and second external electrodes during execution of electroplating, which allows a plated layer to be adequately formed thereon.

An area of the first connection conductor may be smaller than an area of a single region composed of profiles of the pair of first external electrodes, and an area of the second connection conductor may be smaller than an area of a single region composed of profiles of the pair of second external electrodes.

Between the insulator layers and the first and second connection conductors, stress is likely to be generated based on a difference between volume changes (contraction percentages) during a sintering process. Since the first and second connection conductors contract more with increase in area or volume thereof, the generated stress also becomes greater. The Inventors newly found by our research study that the stress based on the difference between volume changes during the sintering process could generate an internal structural defect (e.g., a crack or the like) in the insulator layer located between the first connection conductor and the first external electrodes and in the insulator layer located between the second connection conductor and the second external electrodes. In the light of this study result, the area of the first connection conductor is set smaller than the area of the single region composed of the profiles of the pair of first external electrodes, which makes smaller the stress based on the difference between volume changes during the sintering process. This can suppress the generation of internal structural defect accordingly. Similarly, the area of the second connection conductor is set smaller than the area of the single region composed of the profiles of the pair of second external electrodes, which can suppress the generation of internal structural defect.

The first connection conductor may be located inside the single region composed of the profiles of the pair of first external electrodes when viewed from a direction normal to the first principal face, and the second connection conductor may be located inside the single region composed of the profiles of the pair of second external electrodes when viewed from the direction normal to the first principal face.

The Inventors newly found by our research study that when the edge of the first connection conductor was relatively close to the edges of the first external electrodes, the stress based on the difference between volume changes during the sintering process could generate an internal structural defect in the insulator layer located between the first connection conductor and the first external electrodes and in the insulator layer located between the second connection conductor and the second external electrodes. In the light of this study result, the first connection conductor is located inside the single region composed of the profiles of the pair of first external electrodes when viewed from the direction normal to the first principal face, whereby the edge of the first connection conductor becomes separated from the edges of the first external electrodes. For this reason, it is feasible to further suppress the generation of internal structural defect discussed above. Similarly, the edge of the second connection conductor becomes separated from the edges of the second external electrodes and therefore it is feasible to further suppress the foregoing generation of internal structural defect.

A thickness of the insulator layer located between the first connection conductor and the pair of first external electrodes may be larger than a thickness of the first connection conductor, and a thickness of the insulator layer located between the second connection conductor and the pair of second external electrodes may be larger than a thickness of the second connection conductor. In this case, the thickness of the insulator layer located between the first connection conductor and the pair of first external electrodes is set relatively large, which can prevent the internal structural defect from being generated in the insulator layer located between the first connection conductor and the first external electrodes, because of the stress based on the difference between volume changes during the sintering process. The thickness of the insulator layer located between the second connection conductor and the pair of second external electrodes is set relatively large, which can similarly prevent the internal structural defect from being generated in the insulator layer located between the second connection conductor and the second external electrodes.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description, the same elements or elements with the same functionality will be denoted by the same reference signs, without redundant description.

Figure 1:
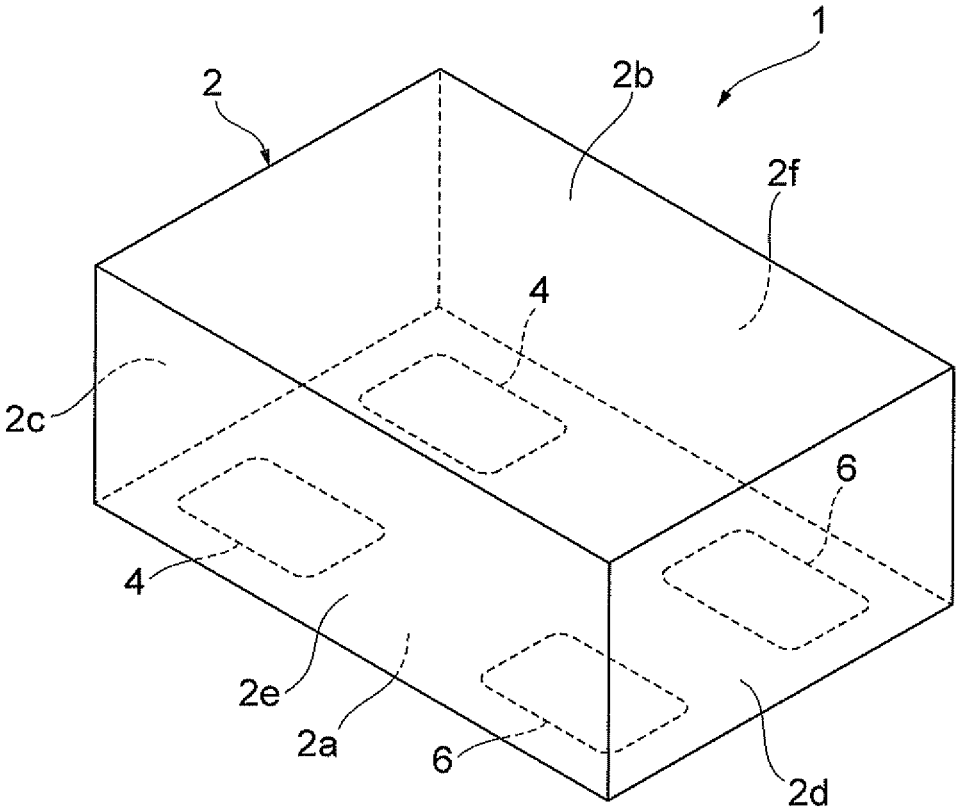
FIG. 1 is a perspective view showing a multilayer coil component according to an embodiment of the present invention.
Figure 2:
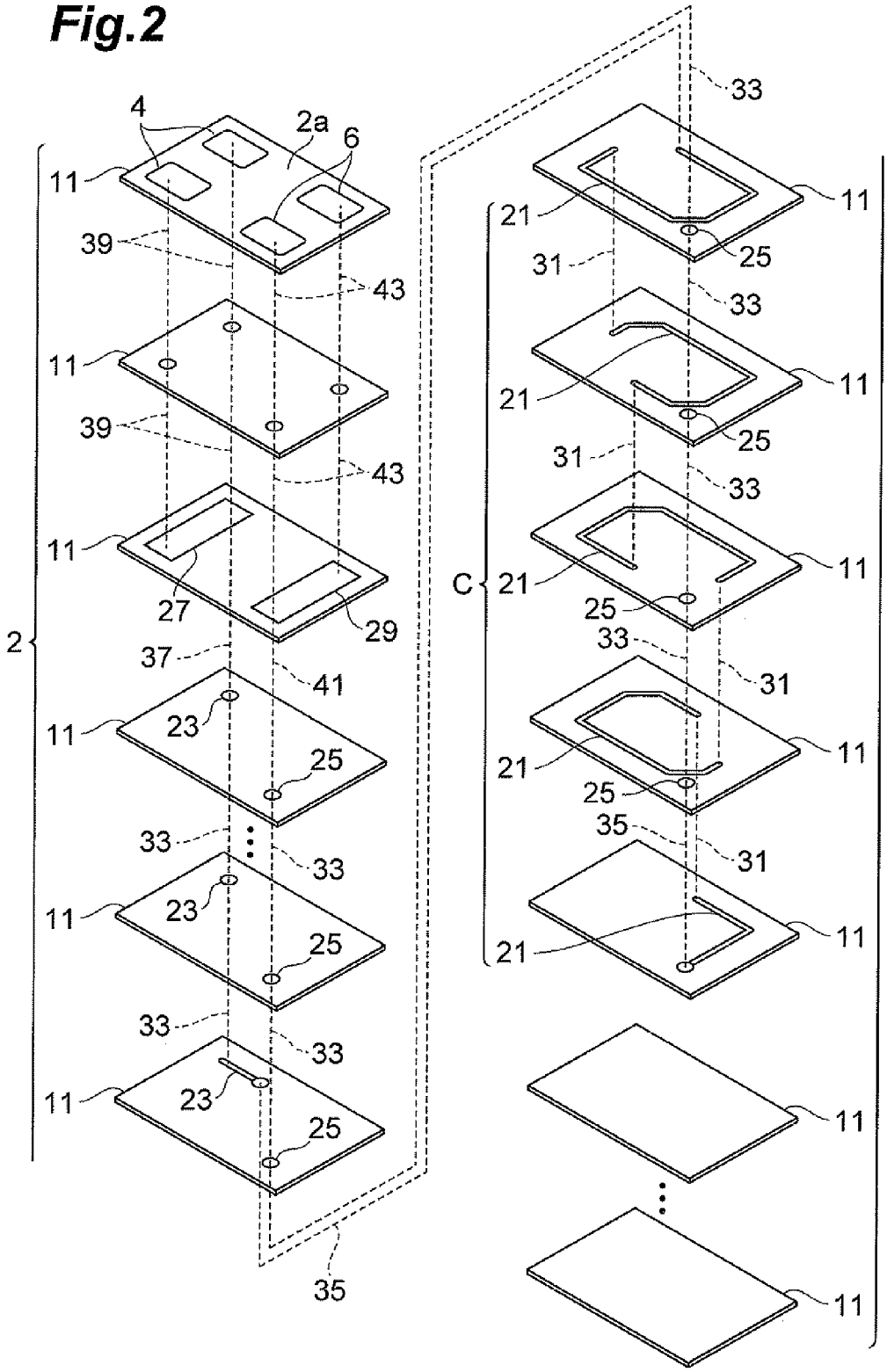
FIG. 2 is an exploded perspective view showing a configuration of an element body in the multilayer coil component according to the embodiment.
Figure 3:
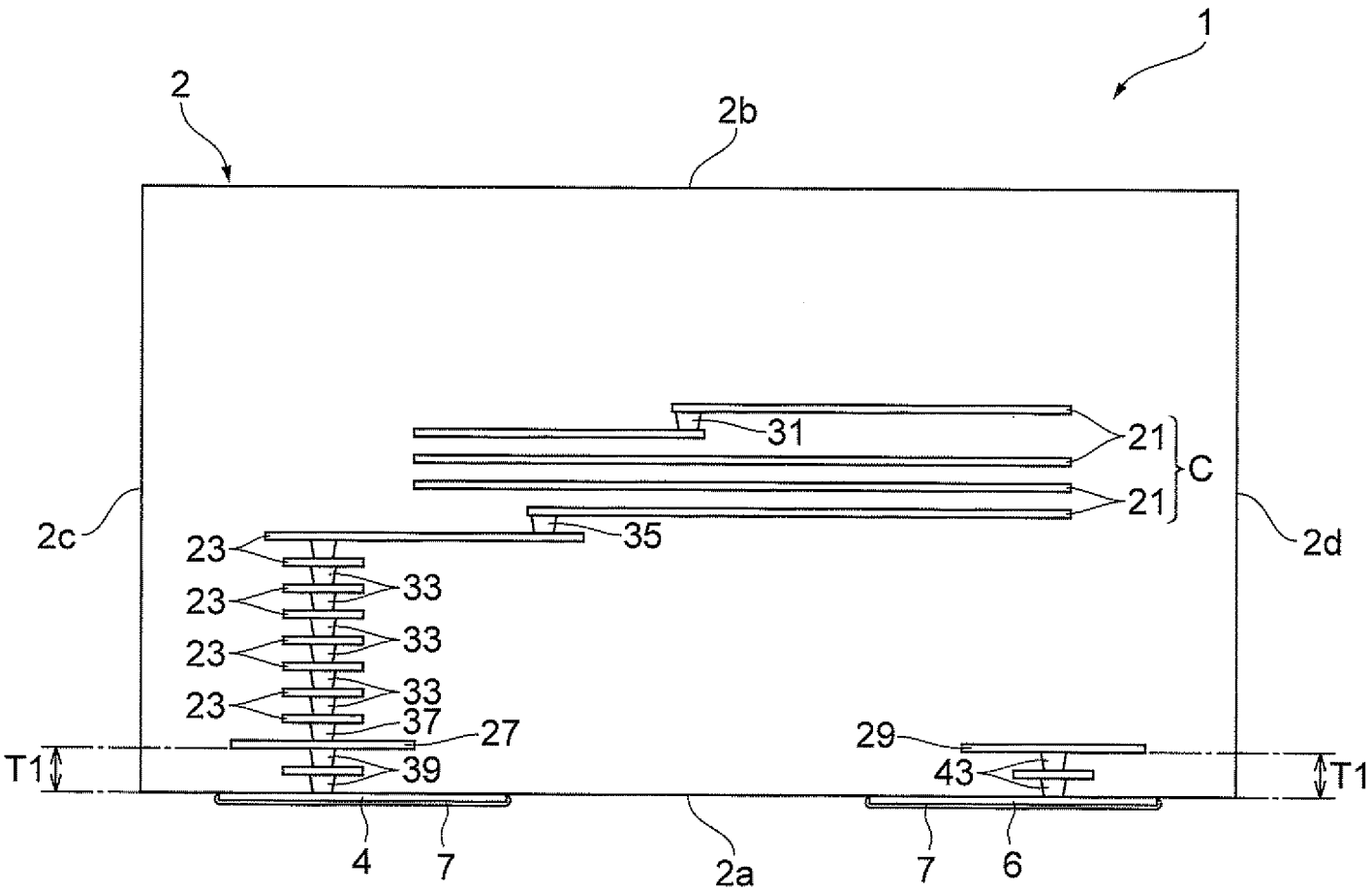
FIG. 3 is a drawing for explaining a sectional configuration of the element body in the multilayer coil component according to the embodiment.
Figure 4:
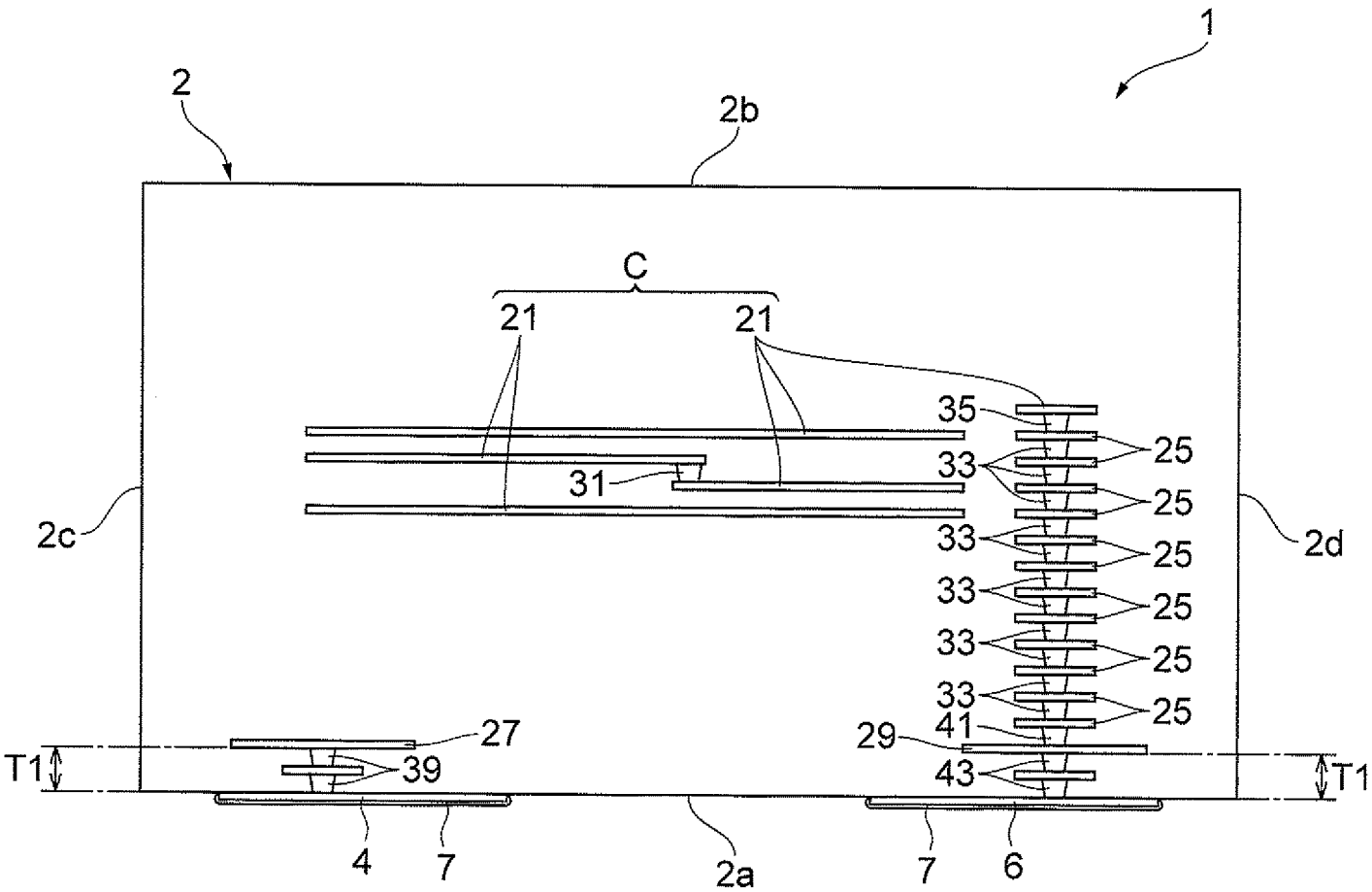
FIG. 4 is a drawing for explaining another sectional configuration of the element body in the multilayer coil component according to the embodiment.
Figure 5:
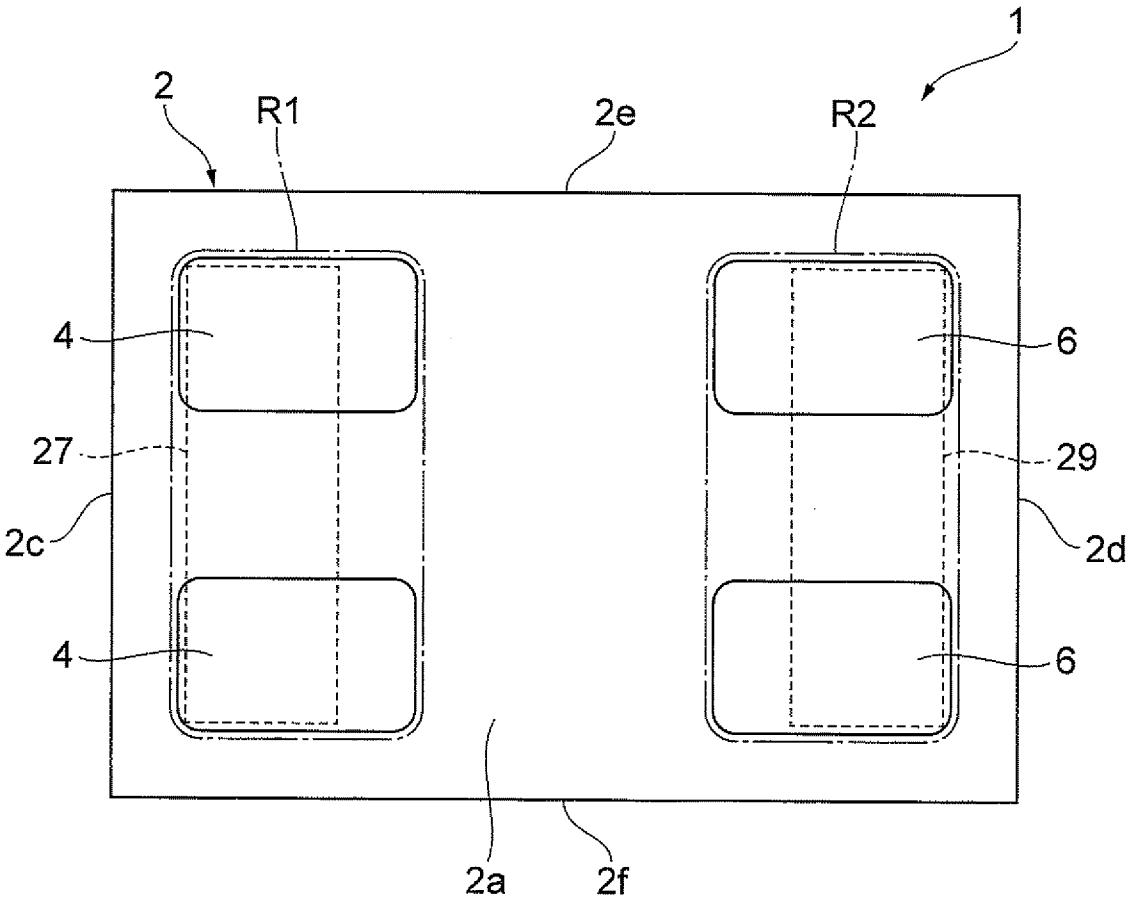
FIG. 5 is a drawing for explaining locations of first and second external electrodes and first and second connection conductors.

First, a configuration of a multilayer coil component 1 according to an embodiment of the present invention will be described with reference to FIGS. 1 to 5. FIG. 1 is a perspective view showing the multilayer coil component according to the present embodiment. FIG. 2 is an exploded perspective view showing a configuration of an element body in the multilayer coil component according to the present embodiment. FIGS. 3 and 4 are drawings for explaining respective sectional configurations of the element body in the multilayer coil component according to the present embodiment. FIG. 5 is a drawing for explaining locations of first and second external electrodes and first and second connection conductors. FIGS. 1 and 2 do not depict plated layers 7 which will be explained later.

The multilayer coil component 1, as shown in FIG. 1, is provided with an element body 2 of a substantially rectangular parallelepiped shape and with a pair of first external electrodes 4 and a pair of second external electrodes 6 arranged on the exterior surface of the element body 2.

The element body 2 has a rectangular parallelepiped shape and has the exterior surface consisting of first and second principal faces 2*a*, 2*b* of a substantially rectangular shape opposed to each other, first and second side faces 2*c*, 2*d* opposed to each other, and third and fourth side faces 2*e*, 2*f* opposed to each other. The first and second side faces 2*c*, 2*d* extend in the short-side direction of the first and second principal faces 2*a*, 2*b* so as to connect the first and second principal faces 2*a*, 2*b*. The third and fourth side faces 2*e*, 2*f* extend in the long-side direction of the first and second principal faces 2*a*, 2*b* so as to connect the first and second principal faces 2*a*, 2*b*.

The element body 2, as shown in FIG. 2, consists of a plurality of insulator layers 11 laminated together. Each of the insulator layers 11 has a substantially rectangular shape. Each insulator layer 11 is an insulator with electrical insulation and is comprised of a sintered body of an insulator green sheet. In a practical form of the element body 1, the insulator layers 11 are integrally formed so that no boundary can be visually recognized between them. Namely, the element body 2 has a laminate of the insulator layers 11.

The insulator layers 11 are comprised, for example, of a ferrite (such as an Ni—Cu—Zn type ferrite, an Ni—Cu—Zn—Mg type ferrite, a Cu—Zn type ferrite, or an Ni—Cu type ferrite). Some of the insulator layers 11 may be comprised of a non-magnetic ferrite.

The pair of first external electrodes 4 and the pair of second external electrodes 6 are arranged on the first principal face 2*a*. The pair of first external electrodes 4 are arranged at an end portion of the first principal face 2*a* nearer the first side face 2*c*, i.e., near one short side of the first principal face 2*a*. The pair of first external electrodes 4 are arranged in juxtaposition so as to be separated from each other in the short-side direction of the first principal face 2*a*. The pair of second external electrodes 6 are arranged at an end portion of the first principal face 2*a* nearer the second side face 2*d*, i.e., near the other short side of the first principal face 2*a*. The pair of second external electrodes 6 are arranged in juxtaposition so as to be separated from each other in the short-side direction of the first principal face 2*a*. The first external electrodes 4 and the second external electrodes 6 are located so as to be separated from each other in the long-side direction of the first principal face 2*a*. Each of the external electrodes 4, 6 is arranged near a corner of the first principal face 2*a*.

Each of the first and second external electrodes 4, 6 has a substantially rectangular shape on a plan view (substantially, a rectangle the long-side direction of which agrees with the long-side direction of the first principal face 2*a*, in the present embodiment) and the corners thereof are round. Each of the first and second external electrodes 4, 6 contains an electroconductive element (e.g., Ag or Pd) and a glass component. Each of the first and second external electrodes 4, 6 is comprised of a sintered body of an electroconductive paste containing an electroconductive metal powder (e.g., an Ag powder or a Pd powder) and a glass frit component. The sintered body forming each of the first and second external electrodes 4, 6 is electroplated and a plated layer 7 is formed on the surface of each of the first and second external electrodes 4, 6. Namely, the multilayer coil component 1, as shown in FIGS. 3 and 4, is provided with the plated layers 7, and the plated layer 7 is arranged on the surface of each of the first and second external electrodes 4, 6. For example, Ni and Sn are used for the electroplating.

The multiplayer coil component 1, as shown in FIGS. 2 to 4, is provided with a plurality of coil conductors (internal conductors) 21, a plurality of extraction conductors 23, 25, a first connection conductor 27, and a second connection conductor 29 in the element body 2. Each of the conductors 21, 23, and 25 contains an electroconductive element (e.g., Ag or Pd). Each of the conductors 21, 23, and 25 is comprised of a sintered body of an electroconductive paste containing an electroconductive material (e.g., an Ag powder or a Pd powder). The first and second connection conductors 27, 29 contain an electroconductive element (e.g., Ag or Pd) and a glass component. The first and second connection conductors 27, 29 are comprised of sintered bodies of an electroconductive paste containing an electroconductive metal powder (e.g., an Ag powder or a Pd powder) and a glass frit component as the first and second external electrodes 4, 6 are.

The coil conductors 21 and the extraction conductors 23, 25 are arranged in juxtaposition in a lamination direction of the insulator layers 11. Ends of the coil conductors 21 are connected by through-hole conductors 31. As the ends of the coil conductors 21 are connected by the through-hole conductors 31, a coil C is formed in the element body 2. Namely, the multilayer coil component 1 is provided with the coil C composed of the coil conductors 21. Each coil conductor 21 is a pattern of less than one turn.

The plurality of extraction conductors 23 are located between the first external electrodes 4 and one end of the coil C and are connected to each other by through-hole conductors 33. The plurality of extraction conductors 25 are located between the second external electrodes 6 and the other end of the coil C and are connected to each other by through-hole conductors 33. The coil conductors 21 located at the ends of the coil C and the extraction conductors 23, 25 adjacent to the pertinent coil conductors 21 are connected to each other by through-hole conductors 35.

The first connection conductor 27 is located between the extraction conductor 23 closest to the first principal face 2*a*, and the first principal face 2*a*. Namely, the first connection conductor 27 is located between the coil C (coil conductors 21) and the first external electrodes 4 in the element body 2. The first connection conductor 27 has a substantially rectangular shape on the plan view (substantially, a rectangle the long-side direction of which agrees with the short-side direction of the first principal face 2*a*, in the present embodiment). The area of the first connection conductor 27 is set to be smaller than the area of a single region R1 composed of profiles of the pair of first external electrodes 4, as shown in FIG. 5. The first connection conductor 27 is located inside the foregoing region R1 when viewed from a direction normal to the first principal face 2*a*.

The first connection conductor 27 and the extraction conductor 23 adjacent thereto are connected to each other by a through-hole conductor 37. This connection results in connecting the first connection conductor 27 and one end of the coil C (coil conductors 21) through each of the extraction conductors 23 and each of the through-hole conductors 33, 35, and 37. The first connection conductor 27 and each of the first external electrodes 4 are connected to each other by a through-hole conductor 39. This connection results in connecting the pair of first external electrodes 4 to each other through the first connection conductor 27 and the through-hole conductors 39. Then, the pair of first external electrodes 4 and the coil C (coil conductors 21) are electrically connected through each of the extraction conductors 23, the first connection conductor 27, and each of the through-hole conductors 33, 35, 37, and 39.

The second connection conductor 29 is located between the extraction conductor 25 closest to the first principal face 2*a*, and the first principal face 2*a*. Namely, the second connection conductor 29 is located between the coil C (coil conductors 21) and the second external electrodes 6 in the element body 2. The second connection conductor 29 has a substantially rectangular shape on the plan view (substantially, a rectangle the long-side direction of which agrees with the short-side direction of the first principal face 2*a*, in the present embodiment). The area of the second connection conductor 29 is set to be smaller than the area of a single region R2 composed of profiles of the pair of second external electrodes 6, as shown in FIG. 5. The second connection conductor 29 is located inside the foregoing region R2 when viewed from the direction normal to the first principal face 2*a*.

The second connection conductor 29 and the extraction conductor 25 adjacent thereto are connected to each other by a through-hole conductor 41. This connection results in connecting the second connection conductor 29 and the other end of the coil C (coil conductors 21) through each of the extraction conductors 25 and each of the through-hole conductors 33, 35, and 41. The second connection conductor 29 and each of the second external electrodes 6 are connected to each other by a through-hole conductor 43. This connection results in connecting the pair of second external electrodes 6 to each other through the second connection conductor 29 and the through-hole conductors 43. Then, the pair of second external electrodes 6 and the coil C (coil conductors 21) are electrically connected through each of the extraction conductors 25, the second connection conductor 29, and each of the through-hole conductors 33, 35, 41, and 43.

Each of the through-hole conductors 33, 35, 37, 39, 41, and 43 also contains an electroconductive element (e.g., Ag or Pd) as each of the conductors 21, 23, 25, 27, and 29 does. Each of the through-hole conductors 33, 35, 37, 39, 41, and 43 is comprised of a sintered body of an electroconductive paste containing an electroconductive material (e.g., an Ag powder or a Pd powder).

The thickness T1 of the insulator layer located between the first and second connection conductors 27, 29 and the first and second external electrodes 4, 6, i.e., the spacing between the first and second connection conductors 27, 29 and the first principal face 2*a*, is set to be larger than the thickness of the first and second connection conductors 27, 29.

In the present embodiment, as described above, since the pair of first external electrodes 4 are electrically connected to one end of the coil C through the first connection conductor 27, neither of the first external electrodes 4 is in the electrically floating state. Since the pair of second external electrodes 6 are electrically connected to the other end of the coil C through the second connection conductor 29, neither of the second external electrodes 6 is in the electrically floating state. These conditions allow an adequate electric field to be applied to the first and second external electrodes 4, 6 during execution of electroplating on the respective pairs of first and second external electrodes 4, 6. As a result, electroplated coatings can be adequately formed on the first and second external electrodes 4, 6 in the multilayer coil component 1.

The area of the first connection conductor 27 is smaller than the area of the foregoing region R1 and the area of the second connection conductor 29 is smaller than the area of the foregoing region R2. For this reason, the volumes of the first and second connection conductors 27, 29 are relatively small, so as to reduce the stress based on the difference between volume changes during the sintering process. Therefore, it is feasible to prevent the internal structural defect from being generated in the insulator layer 11 located between the first and second connection conductors 27, 29 and the first and second external electrodes 4, 6.

The first connection conductor 27 is located inside the region R1 when viewed from the direction normal to the first principal face 2*a*, and the second connection conductor 29 is located inside the region R2 when viewed from the direction normal to the first principal face 2*a*. For this reason, the edge of the first connection conductor 27 is located so as to be separated from the edges of the first external electrodes 4, and the edge of the second connection conductor 29 is located so as to be separated from the edges of the second external electrodes 6. Therefore, it is feasible to further prevent the internal structural defect from being generated in the insulator layer 11 located between the first and second connection conductors 27, 29 and the first and second external electrodes 4, 6.

The thickness T1 of the insulator layer 11 located between the first and second connection conductors 27, 29 and the first and second external electrodes 4, 6 is larger than the thickness of the first and second connection conductors 27, 29. For this reason, it is feasible to prevent the internal structural defect from being generated in the insulator layer 11 located between the first and second connection conductors 27, 29 and the first and second external electrodes 4, 6, because of the stress based on the difference between volume changes during the sintering process.

In the present embodiment, the first and second external electrodes 4, 6 and the first and second connection conductors 27, 29 contain the glass component, so as to enhance adhesion to the insulator layers 11. For this reason, the stress based on the difference between volume changes during the sintering process tends to increase, which can make the generation of internal structural defect more prominent. Therefore, it is preferable to set the areas and the locations of the first and second connection conductors 27, 29 and the thickness T1 of the insulator layer 11 located between the first and second connection conductors 27, 29 and the first and second external electrodes 4, 6, to those as described above.

If each of the first and second external electrodes 4, 6 has a shape with non-round corners, the stress based on the difference between volume changes during the sintering process will be concentrated at the corners, which can make the internal structural defect more likely to be generated there. However, each of the first and second external electrodes 4, 6 is round at the corners in fact, so as to prevent the concentration of the stress based on the difference between volume changes during the sintering process. Therefore, it is feasible to suppress the generation of internal structural defect.

The above described the preferred embodiment of the present invention, but it should be noted that the present invention does not always have to be limited to the aforementioned embodiment and can be modified in many ways without departing from the scope and spirit of the invention.

For example, the first connection conductor 27 and each first external electrode 4 may be connected by a plurality of through-hole conductors 39, and the second connection conductor 29 and each second external electrode 6 may be connected by a plurality of through-hole conductors 43. This configuration improves the reliability of the connection between the first connection conductor 27 and the first external electrodes 4 and the reliability of the connection between the second connection conductor 29 and the second external electrodes 6.

The number of stacked insulator layers 11, the number of stacked coil conductors, and the numbers of stacked extraction conductors 23, 25 do not have to be limited to those in the above embodiment.

The present invention is applicable to the multilayer coil components such as multilayer chip inductors and multilayer chip beads.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A multilayer coil component comprising:

an element body including a laminate of insulator layers, and having first and second principal faces of a substantially rectangular shape opposed to each other, first and second side faces extending in a short-side direction of the first and second principal faces so as to connect the first and second principal faces, and opposed to each other, and third and fourth side faces extending in a long-side direction of the first and second principal faces so as to connect the first and second principal faces, and opposed to each other;

a coil composed of a plurality of internal conductors arranged in the element body and connected to each other;

a pair of first external electrodes arranged at an end portion of the first principal face nearer the first side face, the first external electrodes each having a length extending in a first direction in the first principal surface, the first electrodes being spaced apart from each other in a second direction in the first principal surface, the second direction being perpendicular to the first direction;

a pair of second external electrodes arranged at an end portion of the first principal face nearer the second side face, the second external electrodes each having a length extending in the first direction in the first principal surface, the second electrodes being spaced apart from each other in the second direction in the first principal surface;

a first connection conductor arranged between the coil and the pair of first external electrodes in the element body and connected to one end of the coil and to the pair of first external electrodes, the first connection conductor having a rectangular shape with a uniform width, the uniform width of the first connection conductor extending in the first direction in the first principal surface and being smaller than the length of each of the first external electrodes; and a second connection conductor arranged between the coil and the pair of second external electrodes in the element body and connected to the other end of the coil and to the pair of second external electrodes, the second connection conductor having a rectangular shape with a uniform width, the uniform width of the second connection conductor extending in the first direction in the first principal surface and being smaller than the length of each of the second external electrodes, wherein an area of the first connection conductor is smaller than an area of a single region composed of profiles of the pair of first external electrodes, an area of the second connection conductor is smaller than an area of a single region composed of profiles of the pair of second external electrodes, the first connection conductor is located inside the single region composed of the profiles of the pair of first external electrodes when viewed from a direction normal to the first principal face, the second connection conductor is located inside the single region composed of the profiles of the pair of second external electrodes when viewed from the direction normal to the first principal face, and an entire edge of the first connection conductor is located so as to be separated from edges of the first external electrodes when viewed from a direction perpendicular to the first principal face, and an entire edge of the second connection conductor is located so as to be separated from edges of the second external electrodes when viewed from the direction perpendicular to the first principal face.

2. The multilayer coil component according to claim 1, wherein a thickness of the insulator layer located between the first connection conductor and the pair of first external electrodes is larger than a thickness of the first connection conductor, and wherein a thickness of the insulator layer located between the second connection conductor and the pair of second external electrodes is larger than a thickness of the second connection conductor.

3. The multilayer coil component according to claim 1, wherein each of the first and second external electrodes is shaped as a substantially rectangular shape having a long-side direction which agrees with the long-side direction of the first principal face on a plan view.

4. The multilayer coil component according to claim 1, wherein each of the first and second external electrodes is round at whole corners.

5. The multilayer coil component according to claim 1, further comprising:

an insulator layer laminated between an insulator layer on which the pair of first external electrodes and the pair of second external electrodes are formed and an insulator layer on which the first connection conductor and the second connection conductor are formed.

6. The multilayer coil component according to claim 1, wherein:

the area of the first connection conductor has a rectangular shape with a length and a width;

the area of the second connection conductor has a rectangular shape with a length and a width;

the single region composed of profiles of the pair of first external electrodes has a rectangular shape with a length and a width;

the single region composed of profiles of the pair of second external electrodes has a rectangular shape with a length and a width;

the length and the width of the first connection conductor are shorter than the length and the width of the single region composed of profiles of the pair of first external electrodes, respectively; and the length and the width of the second connection conductor are shorter than the length and the width of the single region composed of profiles of the pair of second external electrodes, respectively.

* * * * *